US007808309B2

(12) United States Patent
Ker et al.

(10) Patent No.: US 7,808,309 B2
(45) Date of Patent: Oct. 5, 2010

(54) CURRENT SOURCE CIRCUIT

(75) Inventors: Ming-Dou Ker, Hsinchu County (TW); Jung-Sheng Chen, Kaohsiung County (TW); Chun-Yuan Hsu, Taipei County (TW)

(73) Assignee: Chunghwa Picture Tubes, Ltd., Taoyuan (TW)

( * ) Notice: Subject to any disclaimer, the term of this patent is extended or adjusted under 35 U.S.C. 154(b) by 0 days.

(21) Appl. No.: 12/022,979

(22) Filed: Jan. 30, 2008

(65) Prior Publication Data

US 2008/0297238 A1 Dec. 4, 2008

(30) Foreign Application Priority Data

May 31, 2007 (TW) ..... 96119579 A

(51) Int. Cl.
*G05F 1/10* (2006.01)
*G05F 3/02* (2006.01)

(52) U.S. Cl. ..... 327/543

(58) Field of Classification Search ..... 327/103, 327/538–543

See application file for complete search history.

(56) References Cited

U.S. PATENT DOCUMENTS 4,642,552 A 2/1987 Suzuki et al.
6,801,186 B2 10/2004 Han et al.
6,815,941 B2 * 11/2004 Butler ..... 323/313
2005/0168265 A1 * 8/2005 Lee et al. ..... 327/536

FOREIGN PATENT DOCUMENTS

TW 1267718 12/2006

OTHER PUBLICATIONS

"Office Action of Taiwan Counterpart Application", issued on May 18, 2010. p1-p5.

* cited by examiner

*Primary Examiner*—Lincoln Donovan
*Assistant Examiner*—Daniel Rojas
(74) *Attorney, Agent, or Firm*—Jianq Chyun IP Office

(57) ABSTRACT

A current source circuit is provided. The circuit includes a first transistor and at least one second transistor. A first source/drain terminal of the first transistor is coupled to a bias voltage. A second source/drain terminal of the first transistor is used to receive a current signal, and the second source/drain terminal of the first transistor is coupled to a gate terminal of the first transistor. A first source/drain terminal of the second transistor is grounded. A second source/drain terminal of the second transistor is coupled to a voltage source and outputs a bias current. A gate terminal of the second transistor is coupled to the gate terminal of the first transistor.

11 Claims, 4 Drawing Sheets

CURRENT SOURCE CIRCUIT

CROSS-REFERENCE TO RELATED APPLICATION

This application claims the priority benefit of Taiwan application serial no. 96119579, filed on May 31, 2007. The entirety of the above-mentioned patent application is hereby incorporated by reference herein and made a part of this specification.

BACKGROUND OF THE INVENTION

1. Field of the Invention

The present invention relates to a current source circuit, and more particularly, to a current source circuit having a compensation threshold voltage.

2. Description of Related Art

Low-temperature poly-silicon (LTPS) technology is a new fabrication processing technology for thin film transistor liquid crystal displays (TFT-LCD). In comparison with conventional amorphous silicon (a-Si) LCD, a LTPS LCD has the advantages of fast response speed, high brightness and high resolution.

Hence, the use of LTPS transistor for application in integrated circuits such as active matrix liquid crystal display (AMLCD) and active matrix organic light emitting diode (AMOLED) has been given a tremendous amount of attention. In a poly-silicon (poly-Si) TFT-LCD, the poly-Si TFT, for example, is utilized in a pixel circuit and a driving circuit on a glass substrate to lower the processing costs. In fact, many LTPS AMLCDs having driving circuits and control circuits mounted on the glass substrate can be implemented in portable systems such as mobile phones, digital cameras and notebook computers. In the future, the development of LTPS fabrication process steers towards realizing the implementation of LCD integration designs such as system-on-panel (SoP) or system-on-glass(SoG), especially display systems that are compact, low in manufacturing costs and low in power consumption.

However, in LTPS fabrication process, the utilization of analog circuit design is inevitable. Hence, the need for bias voltage is arisen. During the LTPS fabrication process, if the bias voltage is not precise enough, the circuit cannot be implemented on the glass substrate. In other words, the bias voltage needs to be precise enough to be utilized on the glass substrate. Defects such as non-uniform performance may result in LTPS fabrication process, which the threshold voltage may be varied and the bias voltage become made imprecise, thus the operation of the circuit is affected.

FIG. 1 is schematic view illustrating a circuit diagram of a circuit diagram of the conventional current source circuit (during an 8 μm LTPS fabrication process). Referring to FIG. 1, a current source circuit 100 is an NMOS transistor. FIG. 2 is a schematic view illustrating a HSPICE simulation showing the relationship between the gate voltage $V_G$ and the drain current $I_D$. In this graph, the operational voltage $V_{DD}$ is set to be 10V, the size of the NMOS transistor is set to be 80 μm/8 μm, the gate bias voltage is set to be between 1.3V~4.3V, and the drain bias voltage is set to be also between 1.3V~4.3V (for the NMOS transistor to operate in saturation). Further, the NMOS transistor has a threshold voltage variation of 50% Gaussian distribution. According to FIG. 2, when the gate voltage $V_G$ is 3.8V, the difference in the drain current $I_D$ is 22 μA, and the variation of the drain current $I_D$ is 88% (the value is obtained by dividing the difference in the current into the average value of the current). This by dividing the difference in the current into the average value of the current). This variation will result in mismatch between the gate voltage $V_G$ and the drain current $I_D$, affecting the normal operation of the entire circuit. Therefore, variation in the threshold voltage affects the operation of the entire circuit.

SUMMARY OF THE INVENTION

The present invention is directed to a current source circuit adapted for minimizing the effect of the threshold voltage on the bias current to ensure the bias current of the current source circuit is more precise.

The present invention is directed to a current source circuit including a first transistor and at least one second transistor. A first source/drain terminal of the first transistor is coupled to a bias voltage, and a second source/drain terminal of the first transistor is used to receive a current signal. Further, the second source/drain terminal of the first transistor is coupled to the gate terminal of the first transistor. A first source/drain terminal of a second transistor is grounded and the second source/drain terminal of the second transistor is coupled to a voltage source to output a bias current. Further the gate terminal of the second transistor is coupled to the gate terminal of the first transistor.

From another point of view, the present invention is directed to a current source circuit including a current mirror module, a voltage divider module, a first transistor, and at least one second transistor. The current mirror module has an input terminal, a first output terminal, and a second output terminal. Further, the output terminal of the current mirror module is coupled to a voltage source. The voltage divider module has an input terminal and an output terminal. Further, the input terminal of the voltage divider module is coupled to the first output terminal of the current mirror module and the output terminal of the voltage divider module is grounded. A first source/drain terminal of the first transistor is coupled to a bias voltage, and a second source/drain terminal of the first transistor is coupled to the second output terminal of the current mirror module. Further, the second source/drain terminal of the first transistor is coupled to a gate terminal of the first transistor. A first source/drain terminal of a second transistor is coupled to the output terminal of the voltage divider module and a second source/drain terminal of the second transistor is coupled to a voltage source to output a bias current. Further, a gate terminal of the second transistor is coupled to the gate terminal of the first transistor.

Through the voltage divider module and the current mirror module, the present invention ensures the first transistor operates in the sub-threshold region to effectively minimize the threshold voltage variation and the bias current outputted by the second transistor being more precise. Further, when the circuit is in operation, no defect such as the non-uniform performance is resulted to affect the overall performance of the circuit.

In order to the make the aforementioned and other objects, features and advantages of the present invention comprehensible, several embodiments accompanied with figures are described in below detail.

DESCRIPTION OF EMBODIMENTS

Generally, a transistor mounted on a glass substrate usually operates in the saturation region. In LTPS fabrication process, the transconductance $g_m$ and the output resistance $r_o$ of the transistor determines the small signal gain and the frequency response of the analog circuit. The parameters of the transconductance $g_m$ and the output resistance $r_o$ of the transistor are described as the equations listed below:

$$g_m = \mu C_{ox}\frac{W}{L}(V_{GS} - V_{TH}) = \frac{2I_D}{(V_{GS} - V_{TH})} \tag{1}$$

$$r_o = \frac{V_A}{I_D} \tag{2}$$

When the transistor is operated in the saturation region, the drain current $I_D$ may be described as the equation listed below:

$$I_D = \mu C_{ox}\frac{W}{L}(V_{GS} - V_{TH})^2 \tag{3}$$

Herein, Equation (3) has not taken the channel length modulation effect and the body effect into consideration. In Equation (3), the threshold voltage of the transistor is an important parameter. If the threshold voltage varies, the drain current $I_D$ varies as well, lowering the performance of the analog circuit on the glass substrate. Hence, the problem with the threshold voltage variation is the primary problem that the present invention is directed to solve.

Figure 3:
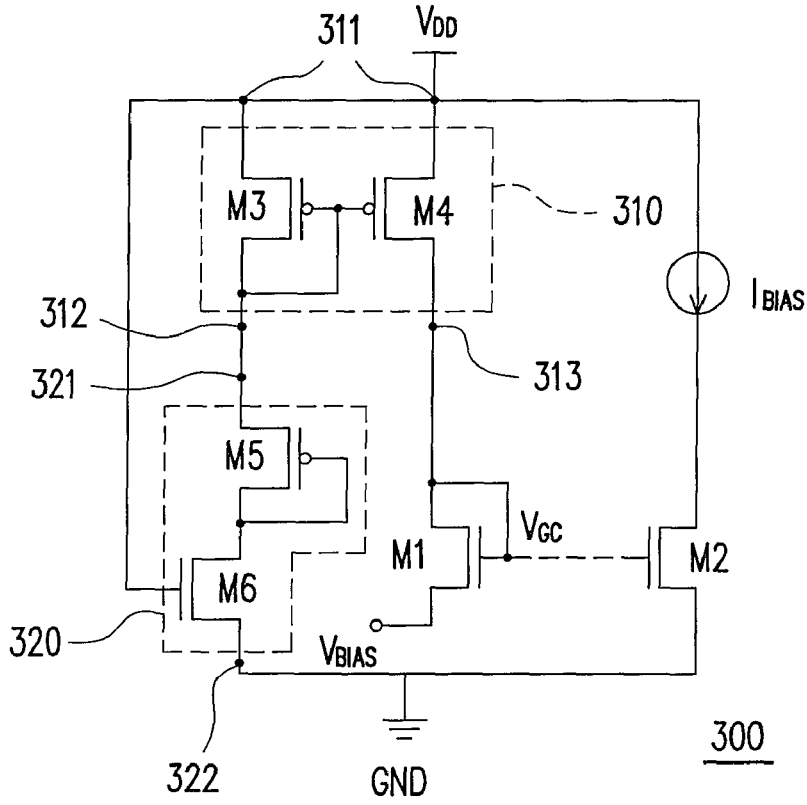
FIG. 3 is a schematic view illustrating a circuit diagram of a current source circuit according to one embodiment of the present invention.

FIG. 3 is a schematic view illustrating a circuit diagram of a current source circuit according to one embodiment of the present invention. Referring to FIG. 3, a current source circuit 300 includes a current mirror module 310, a voltage divider module 320, a first transistor M1, and a second transistor M2. Herein, the current mirror module 310 has an input terminal 311, a first output terminal 312, and a second output terminal 313. Further, the input terminal 311 of the current mirror module 310 is coupled to a voltage source $V_{DD}$ (e.g. $V_{DD}$ provides the operating voltage for the current source circuit 300).

In the present embodiment, the voltage divider module 320 has an input terminal 321 and an output terminal 322. Further, the input terminal 321 of the voltage divider module 320 is coupled to the first output terminal 312 of the current mirror module 310, while the output terminal 322 of the voltage divider module 320 is coupled to a ground terminal GND.

In addition, the first transistor M1 may be an NMOS transistor. Herein, a first source/drain terminal of the first transistor M1 is coupled to a bias voltage $V_{BIAS}$, while a second source/drain terminal of the first transistor M1 is coupled to the second output terminal 313 of the current mirror module 310 and the second source/drain terminal of the first transistor M1 is coupled to a gate terminal of the first transistor M1.

Moreover, the second transistor M2 may be an NMOS transistor. Herein, a first source/drain terminal of the second transistor M2 is coupled to the output terminal 322 of the voltage divider module 320, while a second source/drain terminal of the second transistor is coupled to the voltage source $V_{DD}$ to output a bias current $I_{BIAS}$ and a gate terminal of the second transistor M2 is coupled to the gate terminal of the first transistor M1.

Referring to FIG. 3, the current mirror module 310 includes a third transistor M3 and a fourth transistor M4. Herein, the third transistor M3 may be a PMOS transistor. Further, a first source/drain region of the third transistor M3 is coupled to a gate terminal of the third transistor M3 and the input terminal 321 of the voltage divider module 320 through the first output terminal 312 of the current mirror module 310. On the other hand, a second source/drain terminal of the third transistor M3 is coupled to the bias current $I_{BIAS}$ through the input terminal 311 of the current mirror module 310.

Moreover, the fourth transistor M4 may be a PMOS transistor. Herein, a first source/drain region of the fourth transistor M4 is coupled to the second source/drain terminal of the first transistor M1 through the second output terminal 313 of the current mirror module 310. Additionally, a gate terminal of the fourth transistor M4 and a second source/drain terminal of the fourth transistor M4 are respectively coupled to the gate terminal of the third transistor M3 and the second source/drain region of the third transistor M3. If the parameter of the third transistor M3 matches the parameter of the fourth transistor M4, the current outputted by the first output terminal 312 of the current mirror module 310 is equal to the current outputted by the second output terminal 313 of the current mirror module 310.

In the present embodiment, the voltage divider module 320 includes a fifth transistor M5 and a sixth transistor M6. Herein, the fifth transistor M5 may be a PMOS transistor. Further, a first source/drain terminal of the fifth transistor M5 is coupled to a gate terminal of the fifth transistor M5. In addition, a second source/drain terminal of the fifth transistor M5 is coupled to the first output terminal 312 of the current mirror module 310 through the input terminal 321 of the voltage divider module 320.

On the other hand, the sixth transistor M6 may be an NMOS transistor. Herein, a first source/drain terminal of the sixth transistor M6 is coupled to a ground terminal GND through the output terminal 322 of the voltage divider module 320. Further, a gate terminal of the sixth transistor M6 is coupled to the input terminal 311 of the current mirror module 310. In addition, a second source/drain terminal of the sixth transistor M6 is coupled to the first source/drain terminal of the fifth transistor M5. Through operating the voltage divider module 320, the present invention can ensure the first transistor M1 operates in the sub-threshold region, which is described in detail below.

In the present embodiment, through adjusting the voltage of the source/drain of the six transistor M6 by the voltage divider module 320, the six transistor M6 is operated in the triode region to generate a current. This current is outputted to the source/drain terminal of the first transistor M1 through the second output terminal 313 of the current mirror module 310 so that the first transistor M1 is operated in the sub-threshold region. Further, the gate control voltage $V_{GC}$ of the first transistor M1 is described as the equation listed below:

$$V_{GC} \cong V_{BIAS} + V_{TH_M1} \tag{4}$$

Herein, $V_{TH_M1}$ represents the threshold voltage of the first transistor M1 and $V_{BIAS}$ represent the bias voltage of the source terminal of the first transistor M1. In addition, the gate control voltage $V_{GC}$ is also the gate voltage of the second transistor M2. Moreover, the bias current $I_{BIAS}$ outputted by the second transistor M2 is described as the equation listed below:

$$\begin{aligned} I_{BIAS} &= \frac{1}{2}\mu C_{ox}\left(\frac{W}{L}\right)_{M2}(V_{GC} - V_{TH_M2})^2 \\ &= \frac{1}{2}\mu C_{ox}\left(\frac{W}{L}\right)_{M2}(V_{BIAS} + V_{TH_M1} - V_{TH_M2})^2 \end{aligned} \tag{5}$$

Herein, $V_{TH_M2}$ represents the threshold voltage of the second transistor M2. Through the symmetric layout, the threshold voltage $V_{TH_M1}$ of the first transistor M1 is close to the threshold voltage $V_{TH_M2}$ of the second transistor M2. Therefore, Equation (5) can be re-written as the equation listed below:

$$I_{BIAS} \cong \frac{1}{2}\mu C_{ox}\left(\frac{W}{L}\right)_{M2}(V_{BIAS})^2 \tag{6}$$

Based on Equation (6) above, the bias current $I_{BIAS}$ outputted by the second transistor M2 is independent of the threshold voltage. However, the current value of the bias current $I_{BIAS}$ depends on the bias voltage $V_{BIAS}$. Further, the voltage value of the bias voltage $V_{BIAS}$ determines the current value of the bias current $I_{BIAS}$. Hence, the bias current $I_{BIAS}$ outputted by the second transistor M2 is thus not affected by the threshold voltage variation, ensuring the current value of the bias current $I_{BIAS}$ is more precise.

Figure 4:
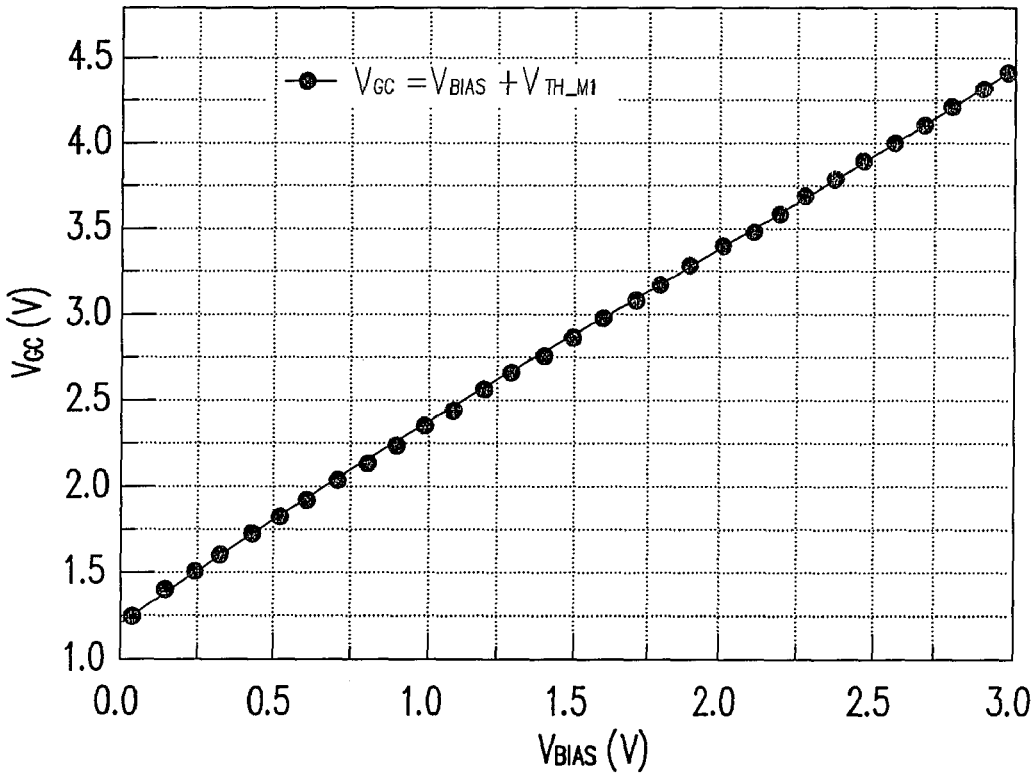
FIG. 4 is a schematic view illustrating the relationship between the gate control voltage and the bias voltage according to one embodiment of the present invention.

Next, the HSPICE simulation result is used to illustrate the advantages of the current source circuit 300 according to the embodiment of the present invention. First, FIG. 4 shows the relationship between the gate control voltage $V_{GC}$ and the bias voltage $V_{BIAS}$. As shown in FIG. 4, the size of the bias voltage $V_{BIAS}$ increases from 0V to 3V and the size of the gate control voltage $V_{GC}$ increases from 1.3V to 4.3V. Further, in an 8 μm LTPS fabrication process, the threshold voltage of the NMOS transistor is close to 1.3V. In addition, $V_{GC} \cong VBIAS + V_{TH_M1}$ and the value of the gate control voltage $V_{GC}$ is also the same as the gate voltage $V_G$ of a conventional circuit.

Figure 5:
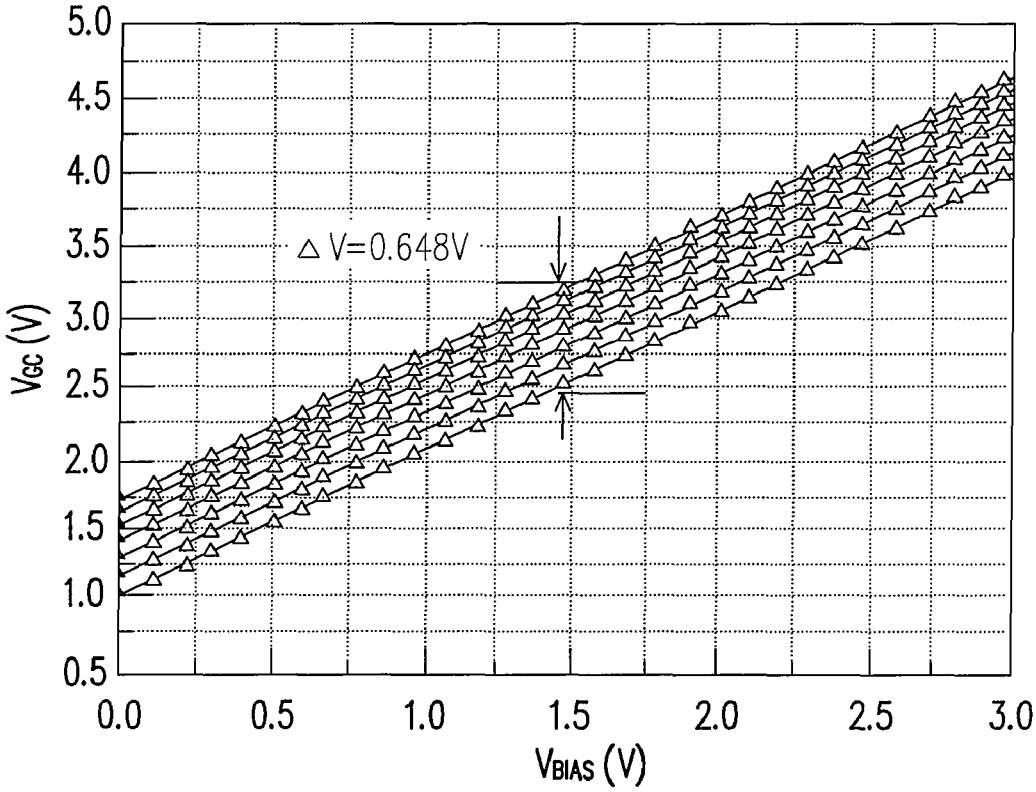
FIG. 5 is a schematic view illustrating the relationship between the gate control voltage and the bias voltage according to one embodiment of the present invention (including a threshold voltage variation of 50% Gaussian distribution).

Second, in the simulation, when the first transistor M1 has a threshold voltage variation of 50% Gaussian distribution, the relationship between the control voltage $V_{GC}$ and the bias voltage $V_{BIAS}$ is as shown in FIG. 5. As shown in FIG. 5, when the threshold voltage variation equals to 50%, the gate control voltage $V_{GC}$ is equal to 0.648V (i.e. $\Delta V_{GC} \cong V_{TH_M1} \times 50\%$). The aforementioned simulation result ensures/is used to ensure the gate voltage of the second transistor M2 is the same as the gate voltage of the conventional circuit.

Figure 1:
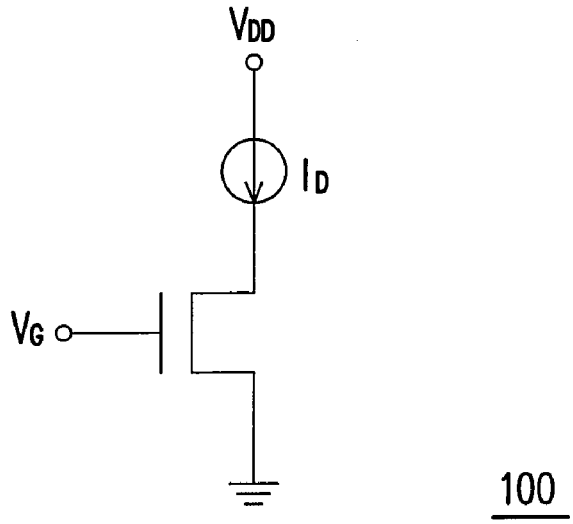
FIG. 1 (PRIOR ART)
FIG. 1 is a schematic view illustrating a circuit diagram of a conventional current source circuit.
Figure 2:
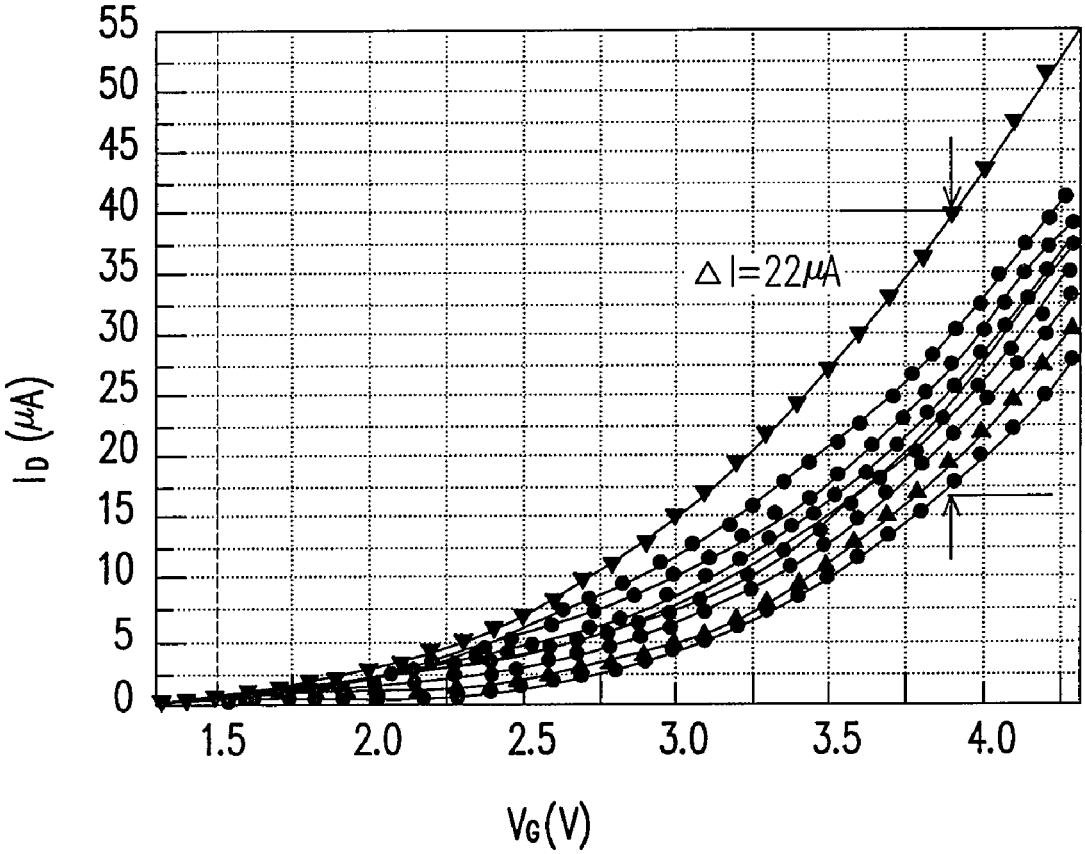
FIG. 2 (PRIOR ART)
FIG. 2 is a schematic view illustrating the relationship between the voltage and the current of a conventional current source circuit.
Figure 6:
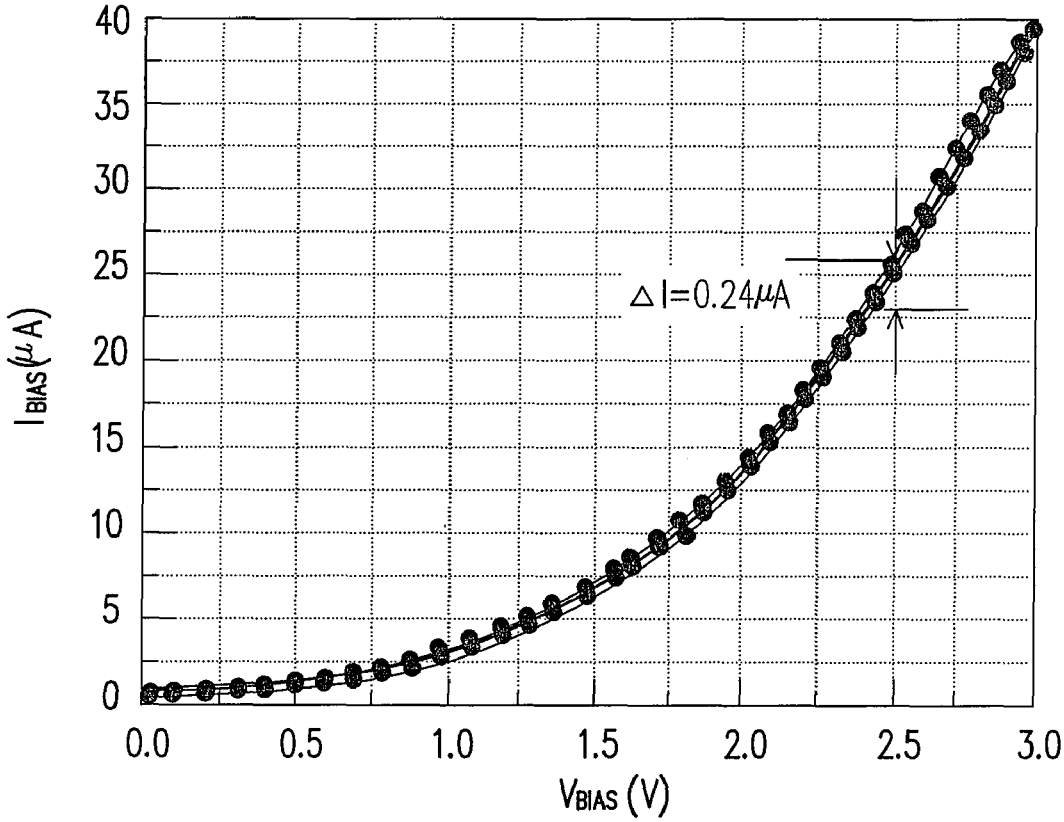
FIG. 6 is a schematic view illustrating the relationship between the bias voltage and the bias current according to one embodiment of the present invention.

Next, parameters that are similar to those of the conventional circuit are used to simulate the relationship between the bias current $I_{BIAS}$ and the bias voltage $V_{BIAS}$. Therefore, the size of the second transistor M2 is 80 μm/8 μm and the second transistor M2 is operated in the saturation region. The simulation results are shown in FIG. 6. As shown in FIG. 6, when the bias voltage $V_{BIAS}$ is 2.5V (according to the simulation results of FIG. 4, the bias voltage $V_{BIAS}$ is 2.5V, which is equivalent to the gate voltage $V_G$, 3.8V, as shown in FIG. 2), and the bias current variation is. Hence, the bias current variation is calculated to be 0.96%. Comparing the simulation result to that of the conventional circuit, when the current source circuit 300 according to the embodiment of the present invention is under the same threshold voltage variation (i.e. 50%), the bias current variation $I_{BIAS}$ lowers significantly from 88% to 0.96%.

However, the aforementioned simulation result is generated when the threshold voltage variation is fixed to 50%. Now, four different examples are used to simulate according to the threshold voltage variation and the average value of the current and the variation are defined as the equations listed below:

$$\text{Average Value} = \frac{I_{D1} + I_{D2} + I_{D3} + I_{D4}}{4}$$

$$\text{Variation}(\%) = \frac{\text{Average Value} - I_{D_\#}}{\text{Average Value}} \times 100\%$$

Herein, $I_{D1}$, $I_{D2}$, $I_{D3}$, and $I_{D4}$ respectively represent the source currents for the four different examples 1~4. Further, the parameters for the simulations are described as follows.

Figure 7:
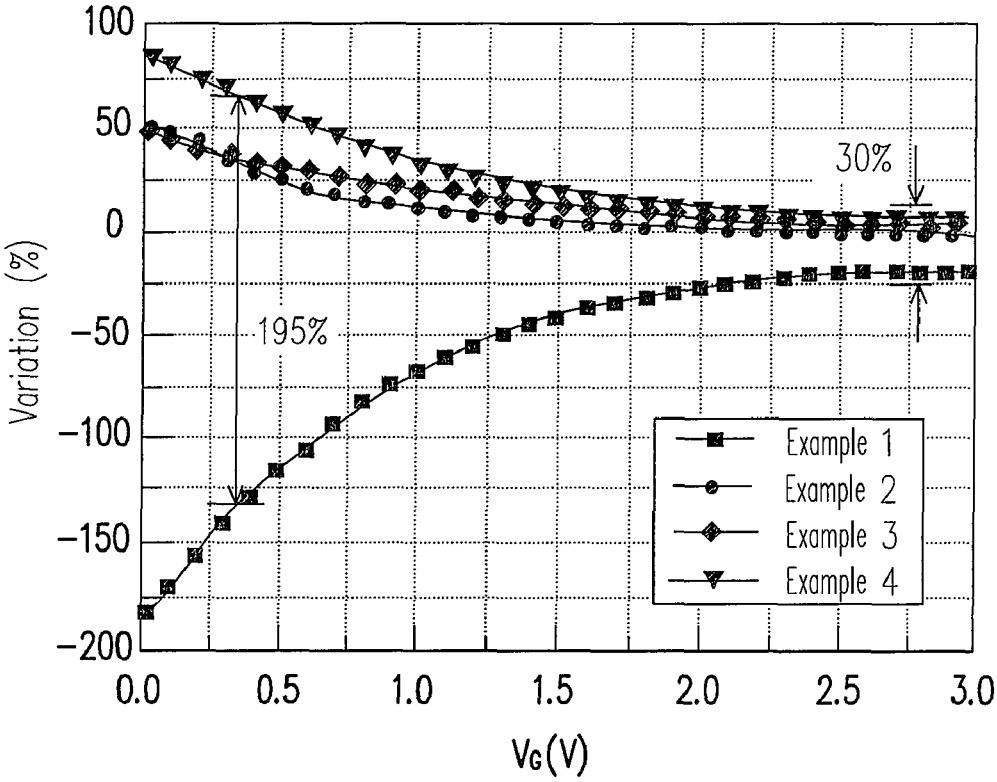
FIG. 7 is a schematic view illustrating the relationship between the threshold voltage variation and the gate voltage of a conventional current source circuit.
Figure 8:
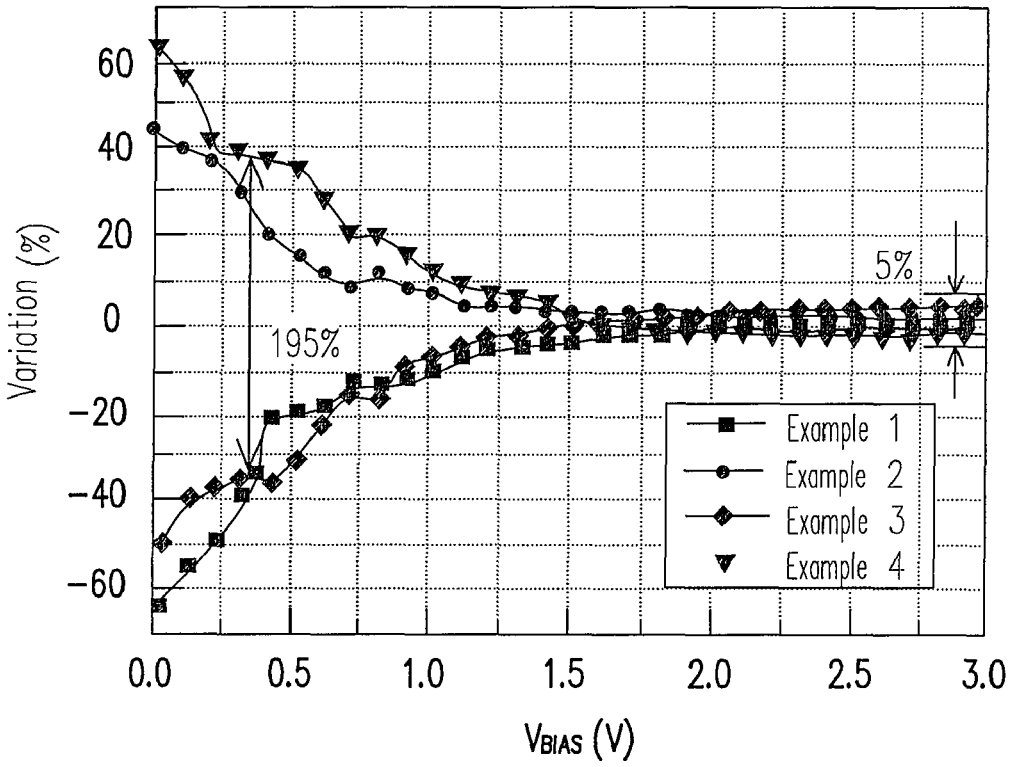
FIG. 8 is a schematic view illustrating the relationship between the threshold voltage variation and the bias voltage according to one embodiment of the present invention.

The voltage $V_{DD}$ is 10V, the size of the transistor is 80 μm/8 μm, the conventional voltage $V_G$ of 1.3~4.3V is standardized to 0~3V to facilitate comparison, and the bias voltage $V_{BIAS}$ is the same as that described in the embodiment of the present invention. Additionally, the simulation results are respectively shown in FIG. 7 and FIG. 8. FIG. 7 is a schematic view illustrating the relationship between the threshold voltage variation and the gate voltage of a conventional current source circuit. FIG. 8 is a schematic view illustrating the relationship between the threshold voltage variation and the bias voltage according to one embodiment of the present invention.

Referring to FIG. 7, when the gate voltage $V_G$ increases from 0V to 3V, the threshold voltage variation lowers from 195% to 30%. Referring to FIG. 8, when the bias voltage $V_{BIAS}$ increases from 0V to 3V, the threshold voltage variation lowers from 75% to 5%. After comparing FIG. 7 to FIG. 8, it can be seen that the current source circuit 300 according to the embodiment of the present invention can effectively lower the threshold voltage variation from 30% achieved by the conventional current source circuit 100 to 5%. Therefore, the bias current $I_{BIAS}$ generated by the current source circuit of the present invention is more precise than that generated by the conventional current source circuit, which is not affected by the threshold voltage variation.

Those skilled in the art should know that the number of the second transistor M2 is not limited to only 1. More specifically, the number of the second transistor M2 can be varied according to the user's requirement to 2 or more than 2.

In view of the above, through the voltage divider module and the current mirror module, the present invention ensures the first transistor operates in the sub-threshold region to effectively minimize threshold voltage variation and ensure the bias current outputted by the second transistor is more precise. Further, when the circuit is in operation, no defect such non-uniform performance is resulted to affect the overall performance of the circuit.

Although the present invention has been disclosed above by the embodiments, they are not intended to limit the present invention. Anybody skilled in the art can make some modifications and alteration without departing from the spirit and scope of the present invention. Therefore, the protecting range of the present invention falls in the appended claims.

What is claimed is:

1. A current source circuit comprising:

a first transistor, having a first source/drain terminal coupled to a bias voltage, a second source/drain terminal receiving a current signal, and the second source/drain terminal coupled to the gate terminal of the first transistor; and at least one second transistor, having a first source/drain terminal directly grounded, a second source/drain terminal coupled to a voltage source to output a bias current, and a gate terminal coupled to the gate terminal of the first transistor, wherein the bias voltage is different from a voltage at the first source/drain terminal of the second transistor, and the bias current outputted by the second transistor is independent of a threshold voltage of the second transistor when the threshold voltage of the second transistor is substantially equal to a threshold voltage of the first transistor such that the bias voltage determines the bias current.

2. The current source circuit of claim 1, wherein the first transistor is operated in a sub-threshold region.

3. The current source circuit of claim 1, wherein the first transistor and the second transistor are both NMOS transistors.

4. A current source circuit, comprising:

a current mirror module having an input terminal coupled to a voltage source, a first output terminal, and a second output terminal;

a voltage divider module having an input terminal coupled to the first output terminal of the current mirror module and an output terminal directly grounded;

a first transistor, having a first source/drain terminal coupled to a bias voltage, a second source/drain terminal coupled to the second output terminal of the current mirror module, and a gate terminal coupled to the second source/drain terminal of the first transistor; and at least one second transistor, having a first source/drain terminal directly connected to the output terminal of the voltage divider module, a second source/drain terminal coupled to the voltage source to output a bias current, and a gate terminal coupled to the gate terminal of the first transistor, wherein the bias voltage is different from a voltage at the first source/drain terminal of the second transistor, and the bias current outputted by the second transistor is independent of a threshold voltage of the second transistor when a threshold voltage of the second transistor is substantially equal to the threshold voltage of the first transistor such that the bias voltage determines the bias current.

5. The current source circuit of claim 4, wherein the first transistor is operated in a sub-threshold region.

6. The current source circuit of claim 4, wherein the first transistor and the second transistor are both NMOS transistors.

7. The current source circuit of claim 4, wherein the current mirror module comprises:

a third transistor, having a first source/drain terminal coupled to a gate terminal of the third transistor and the output terminal of the voltage divider module through the first output terminal of the current mirror module, and a second source/drain terminal coupled to the bias current through the input terminal of the current mirror module; and a fourth transistor, having a first source/drain region of the fourth transistor is coupled to the second source/drain terminal of the first transistor through the second output terminal of the current mirror module, and a gate terminal of the fourth transistor and a second source/drain terminal of the fourth transistor are respectively coupled to the gate terminal of the third transistor and the second source/drain region of the third transistor.

8. The current source circuit of claim 7, wherein the third transistor and the fourth transistor are both PMOS transistors.

9. The current source circuit of claim 4, wherein the voltage divider module comprises:

a fifth transistor, having a first source/drain terminal coupled to a gate terminal of the fifth transistor, and a second source/drain terminal coupled to the first output terminal of the voltage mirror module through the input terminal of the voltage divider module; and a sixth transistor, having a first source/drain terminal grounded through the output terminal of the voltage divider module, a gate terminal coupled to the input terminal of the current mirror module, and a second source/drain terminal coupled to the first source/drain terminal of the fifth transistor.

10. The current source circuit of claim 9, wherein the fifth transistor is a PMOS transistor.

11. The current source circuit of claim 9, wherein the sixth transistor is an NMOS transistor.

* * * * *